US006851975B2

(12) United States Patent
VanEpps, Jr.

(10) Patent No.: US 6,851,975 B2
(45) Date of Patent: Feb. 8, 2005

(54) IMPACT TOLERANT CONNECTOR

(75) Inventor: Daniel J. VanEpps, Jr., Apex, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 10/361,243

(22) Filed: Feb. 10, 2003

(65) Prior Publication Data

US 2004/0157489 A1 Aug. 12, 2004

(51) Int. Cl.[7] ..... H01R 13/40
(52) U.S. Cl. ..... 439/592
(58) Field of Search ..... 439/592, 60, 62, 439/636, 265, 188, 830, 593, 67, 247, 248, 83; 200/51.09, 51.1, 307

(56) References Cited

U.S. PATENT DOCUMENTS 2,480,142 A * 8/1949 Lager ..... 173/324
3,880,492 A * 4/1975 Shlesinger, Jr. ..... 339/117
5,378,161 A * 1/1995 Loder ..... 439/77
5,482,477 A 1/1996 Michael
5,611,717 A * 3/1997 Joly ..... 439/857
5,769,652 A 6/1998 Wider
6,540,535 B1 * 4/2003 Zhu et al. ..... 439/188
6,692,315 B1 * 2/2004 Soumillon et al. ..... 439/830

* cited by examiner

*Primary Examiner*—Alex Gilman
(74) *Attorney, Agent, or Firm*—Coats & Bennett, P.L.L.C.

(57) ABSTRACT

A connector mounted to a printed circuit board permits an inserted plug to displace from an inserted position to a displaced position responsive to an impact force exerted on the inserted plug. The connector includes a housing comprised of one or more sidewalls, and a cavity within the housing. The cavity receives and releasably retains the inserted plug in the inserted position, while one or more contacts disposed within the cavity electrically couple the inserted plug to an electrical circuit disposed on the printed circuit board. One or more openings in the sidewalls yieldably retain the inserted plug in the inserted position, while permitting the displacement of the inserted plug through the one or more openings.

30 Claims, 11 Drawing Sheets

IMPACT TOLERANT CONNECTOR

BACKGROUND OF THE INVENTION

The present invention relates generally to connectors in electronics devices, and in particular, to impact tolerant connectors for mounting on printed circuit boards.

Various electronics devices include connectors mounted to a printed circuit board that facilitate the coupling of peripherals to the electronics device. One example is an audio jack in a mobile telephone for connecting a hands-free headset. While these standard connectors are useful, they tend to trap a plug inserted into the connector on all sides. Thus, any impact experienced by the inserted plug, such as when the electronics device is dropped, may be imparted to connector. These forces can cause the solder joints that secure the connectors to the printed circuit board and/or the connectors themselves to break. It is known to use spring contacts to partially absorb the forces on the connectors, but only at the expense of additional space and cost. Therefore, there remains a need for an economical connector that can withstand impact forces without breaking or dislodging.

SUMMARY OF THE INVENTION

The present invention relates to a board-mounted connector designed to withstand impact forces imparted to the connector. In one embodiment, the connector includes a housing, a cavity disposed within the housing, and one or more electrical contacts disposed within the cavity. The cavity receives and releasably retains the inserted plug in an inserted position, while the contacts electrically couple the inserted plug to an electrical circuit on the printed circuit board. The housing includes one or more openings sized to yieldably retain the inserted plug in the inserted position and, upon impact, expand to permit displacement of the inserted plug through the one or more openings. Thus, the connector reduces the stresses on the connector by allowing the inserted plug to displace from the inserted position to a displaced position.

DETAILED DESCRIPTION OF THE INVENTION

Figure 1:
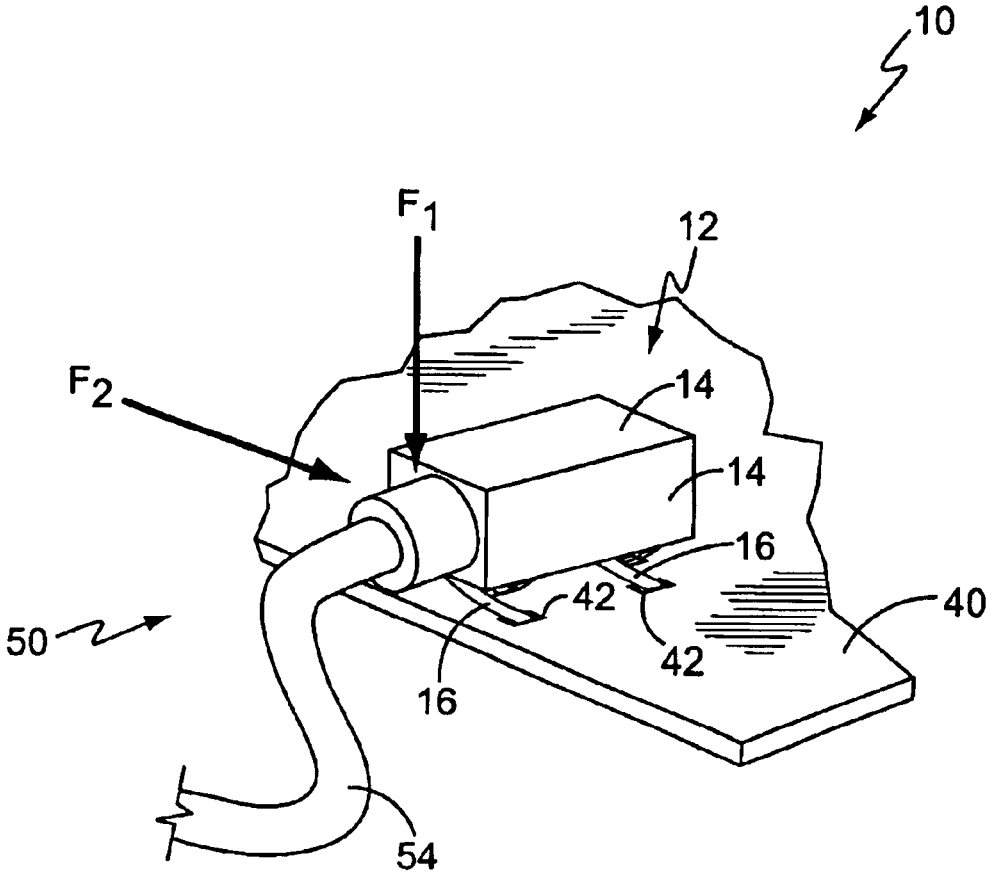
FIG. 1 PRIOR ART
FIG. 1 illustrates a prior art connector and forces that may be imparted to the plug during an impact.

Referring now to FIG. 1, a prior art connector, indicated generally by the number 10, is shown mounted to a printed circuit board (PCB) 40. Connector 10 comprises a housing 12 formed by sidewalls 14. A plurality of contacts 16 are soldered to corresponding contact pads 42, thereby securing the connector 10 to the PCB 40. When a plug 50 is inserted into the connector 10, the contacts 16 electrically couple the inserted plug 50 to one or more electrical circuits (not shown) disposed on the PCB 40.

It is not uncommon for an electronics device to be dropped from time to time, thereby imparting impact forces on the inserted plug 50. Examples of these forces are shown in FIG. 1 as $F_1$ and $F_2$. It is readily apparent that the sidewalls 14 of prior art connector 10 trap the inserted portion of the plug 50 on all sides such that during impact, forces $F_1$ and $F_2$ may be imparted to the sidewalls 14 and to the solder joints securing contacts 16 to contact pads 42. Unfortunately, forces $F_1$ and $F_2$ may be sufficient to break or crack the prior art connector 10, as well as the solder joints between contacts 16 and contact pads 42, therefore rendering the connector 10 inoperable, or its connections unreliable.

Figure 2:
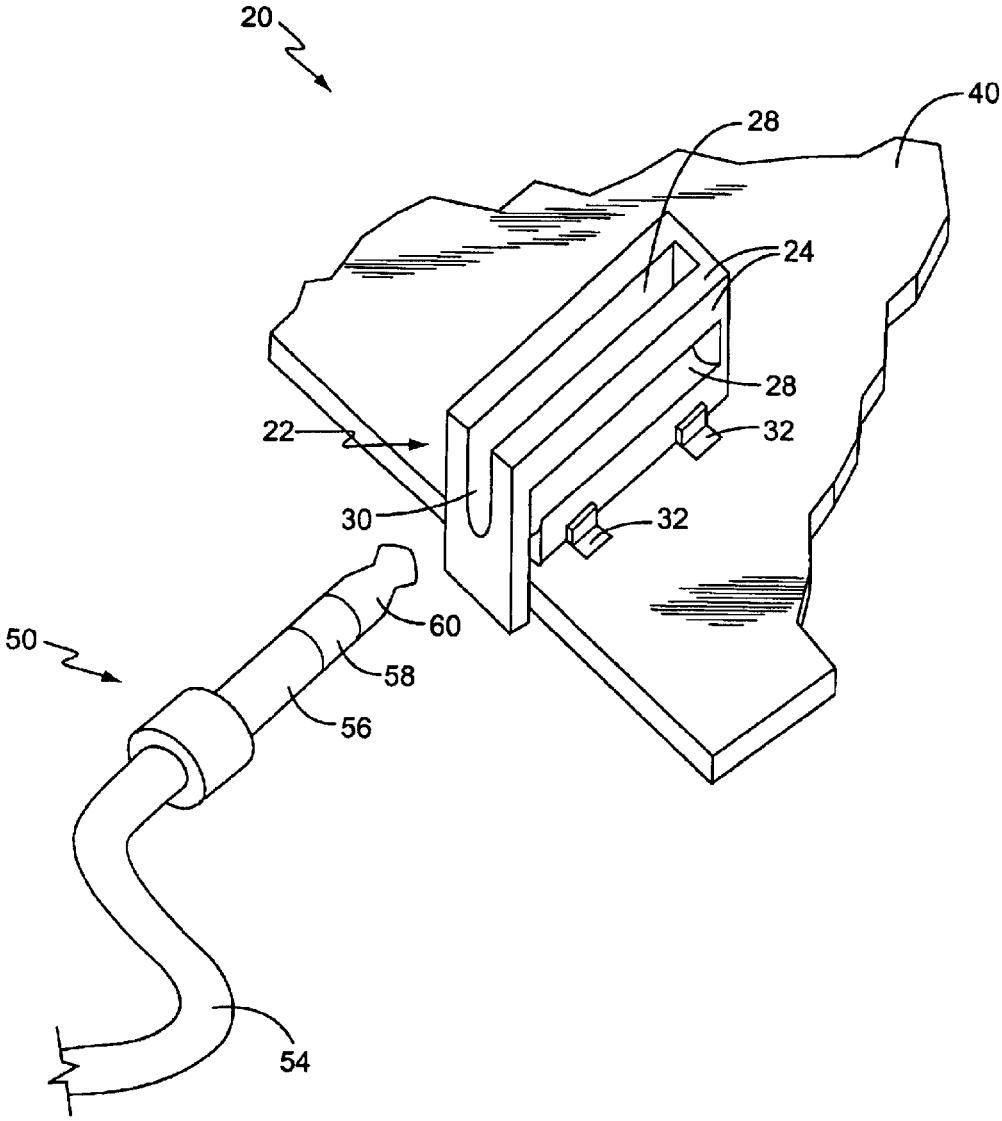
FIG. 2 illustrates one embodiment of the present invention.

An impact tolerant connector of the present invention, shown in FIG. 2 and indicated generally by the number 20, provides an improvement over the prior art connector 10 by allowing some displacement of the inserted plug 50 to reduce the stresses resulting from impact forces on the inserted plug 50. Impact tolerant connector 20 is mounted to PCB 40, and has a cavity 30 to receive and releasably retain the plug 50 upon insertion. Plug 50 may be a segmented plug, for example, a standard 2.5 mm or 3.5 mm plug that connects to the peripheral device (not shown) via cable 54. By way of example, the peripheral device may be a hands-free headset for use with a wireless communications device, such as a mobile telephone. Thus, the segments on plug 50 may comprise a ground segment 56, an audio segment 58, and a microphone segment 60. Connector 20 may be used with many other types of plugs 50 connected to various types of peripheral devices. Examples of other peripheral devices that may include plug 50 include battery chargers and power supplies.

Figure 3:
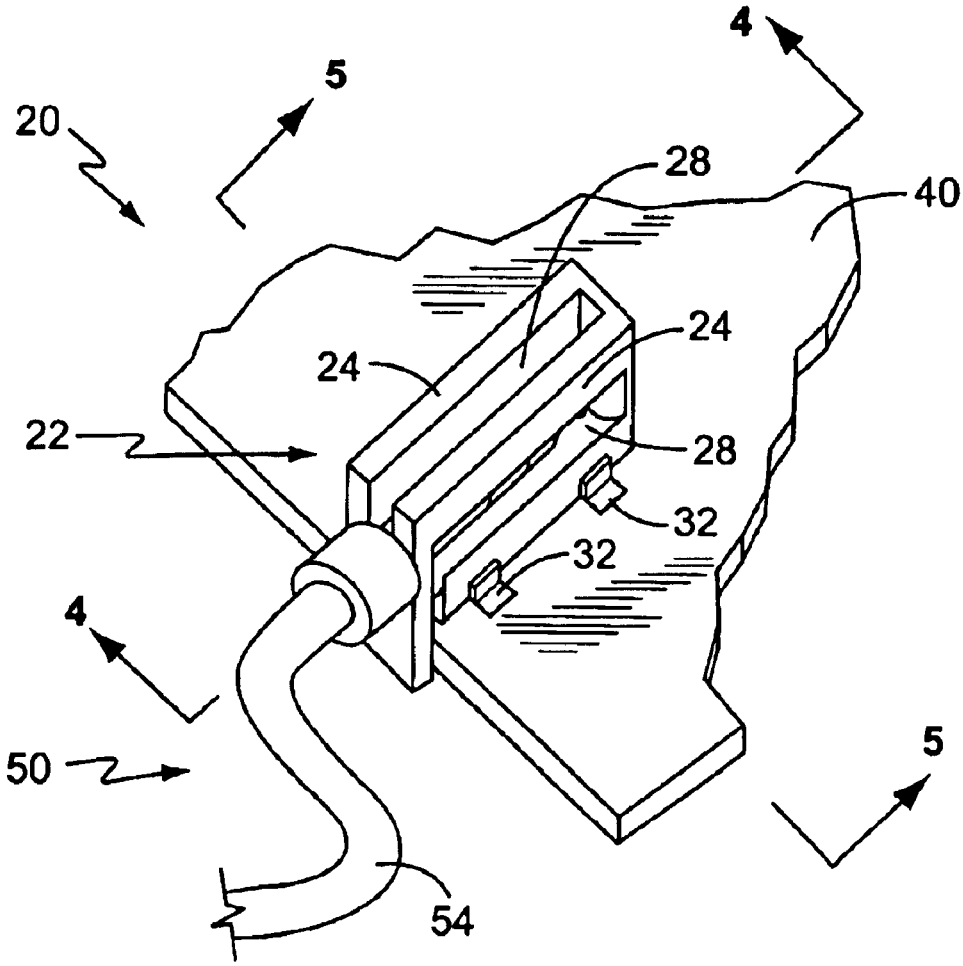
FIG. 3 illustrates a plug inserted into one embodiment of the present invention.

The plug 50 mates with connector 20, as shown in FIG. 3, by inserting plug 50 into the cavity 30, such that the plug 50 assumes an inserted position. In the inserted position, plug 50 couples a peripheral device to one or more electrical circuits disposed on the PCB 40. Thus, considering the example of a hands-free headset above, a user may communicate using the mobile telephone without having the mobile telephone in close proximity to the user's head.

Figure 4:
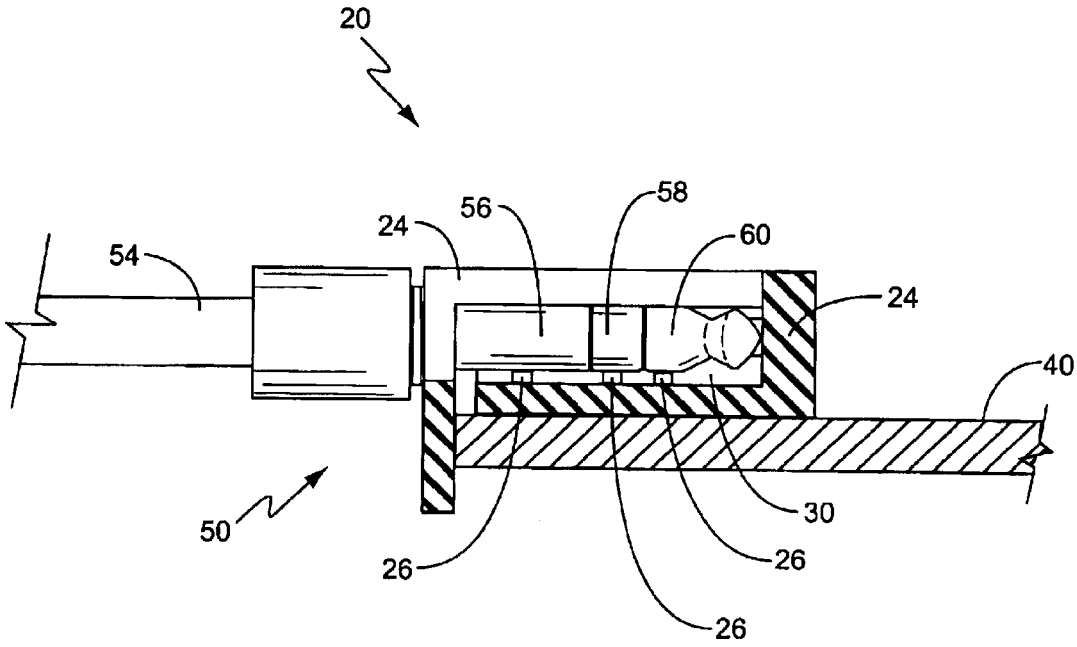
FIG. 4 illustrates FIG. 3 along line 4, and shows the contacts engaging the inserted plug in one embodiment of the present invention.

The connector 20 includes a housing 22 preferably constructed from a non-conductive, pliable material, such as plastic. However, those skilled in the art will realize that the material described herein is illustrative only, and any suitable material known in the art may be used to construct housing 22. Connector 20 further includes contacts 26 within cavity 30, as shown in FIG. 4, that electrically couple the inserted plug 50 to electrical circuits disposed on the PCB 40 by contacting the corresponding segments of inserted plug 50. The contacts 26 may be any contacts known in the art, and may be configured for surface mounting and/or through-hole mounting to PCB 40.

Figure 5:
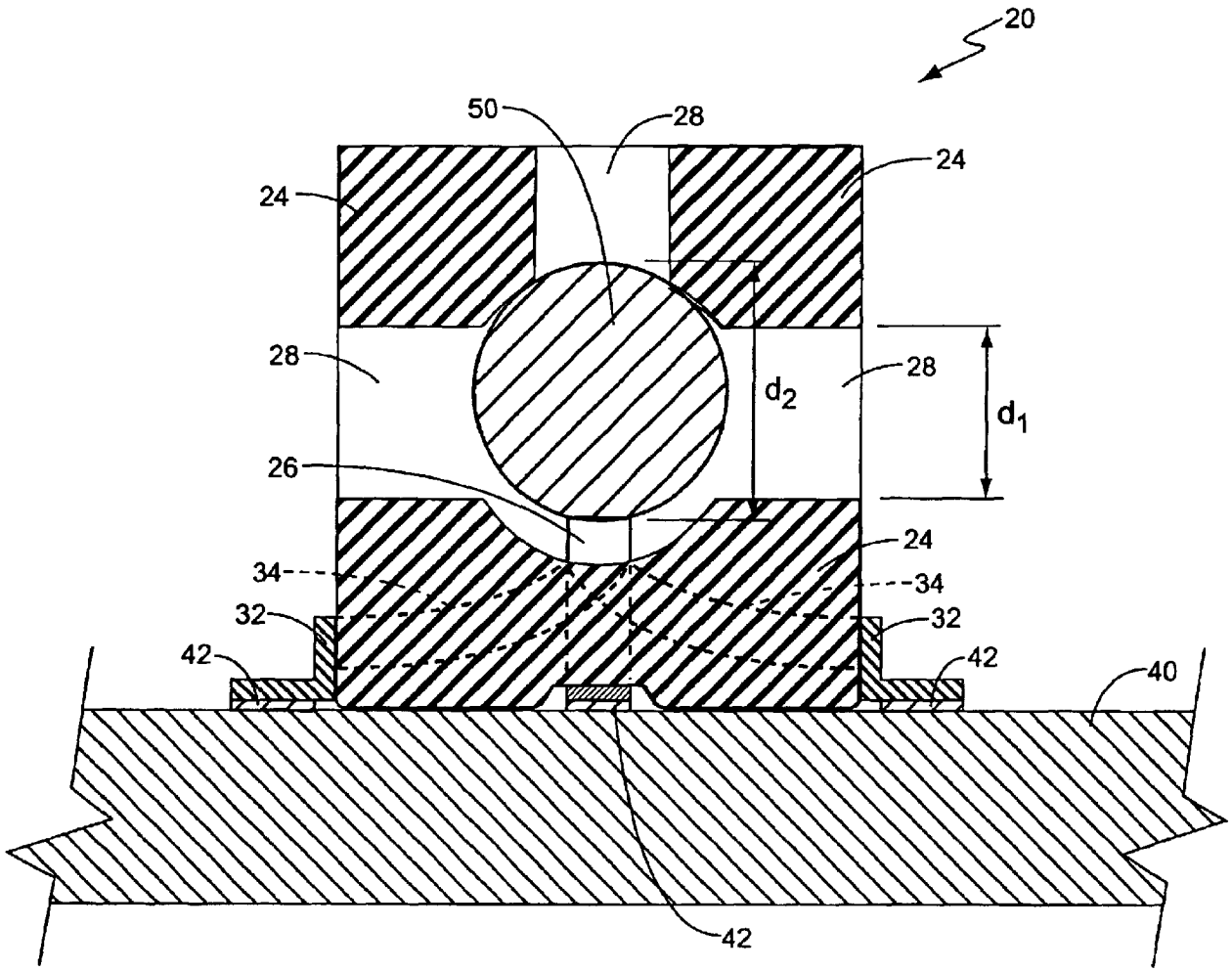
FIG. 5 illustrates FIG. 3 along line 5, and shows the mounting of the connector, as well as the electrical coupling of the inserted plug to the printed circuit board in one embodiment of the present invention.

FIG. 5 illustrates an exemplary method of mounting connector 20 to PCB 40, as well as a more detailed view of the interaction between the contacts 26, openings 28, and the inserted plug 50. In FIG. 5, a contact 26 extends into the cavity 30 and engages the inserted plug 50, such that inserted plug 50 is urged into surface contact with the inner surface of the housing 22. This surface contact, which aids in the insertion alignment of the plug 50, helps to releasably retain the inserted plug 50 in the cavity 30. Further, the contact 26 extends downward through housing 22 for attachment to the contact pad 42 of the PCB 40. Although contact 26 is shown in a surface mount configuration, it should be understood that it may also be adapted for through-hole mounting on the PCB 40.

Alternatively, contact 26 may include a contact lead 34 that extends through the housing 22, and connects to optional mounting leads 32, which are in turn, secured to the additional contact pads 42. While not required, the mounting leads 32 add mounting stability and robustness to the connector 20.

The housing 22 includes one or more openings 28 that permit displacement of the inserted plug 50 as a result of impact forces. The openings 28 formed in the sidewalls 24 are sized to yieldably retain the inserted plug 50 within the cavity 30. In one embodiment, the size $d_1$ of the openings 28 is slightly smaller than the diameter $d_2$ of the inserted plug 50. This slight variation in the size of the openings 28 permits the inserted plug 50 to remain mated in the cavity 30 of connector 20 in the inserted position, and provides yielding resistance to the displacing movement of the inserted plug 50, as it displaces from the inserted position in response to the impact force.

Figure 6A:
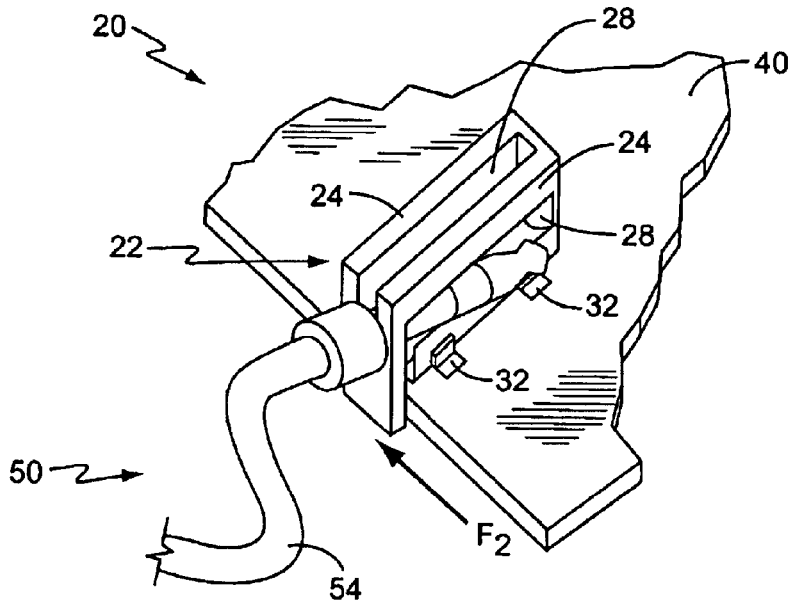
FIGS. 6*a*–6*c* illustrate exemplary plug displacement positions.
Figure 6B:
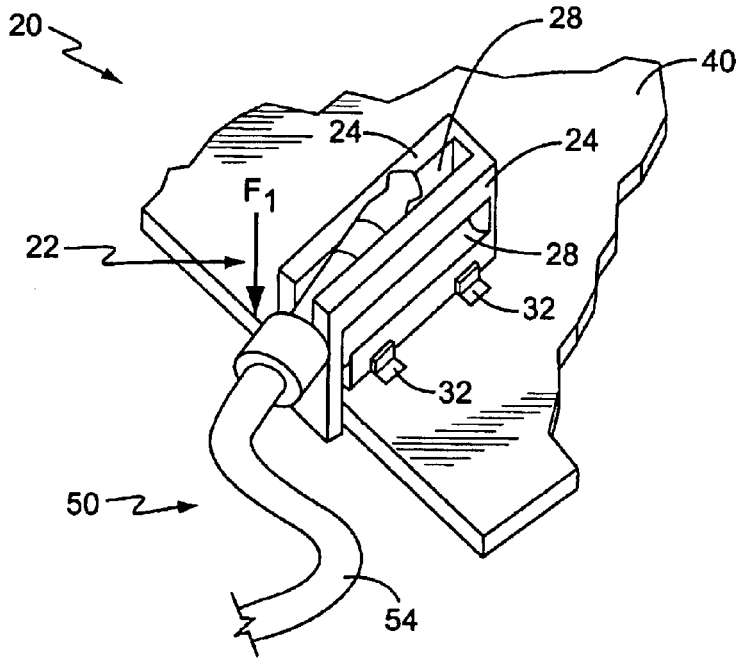
Figure 6C:
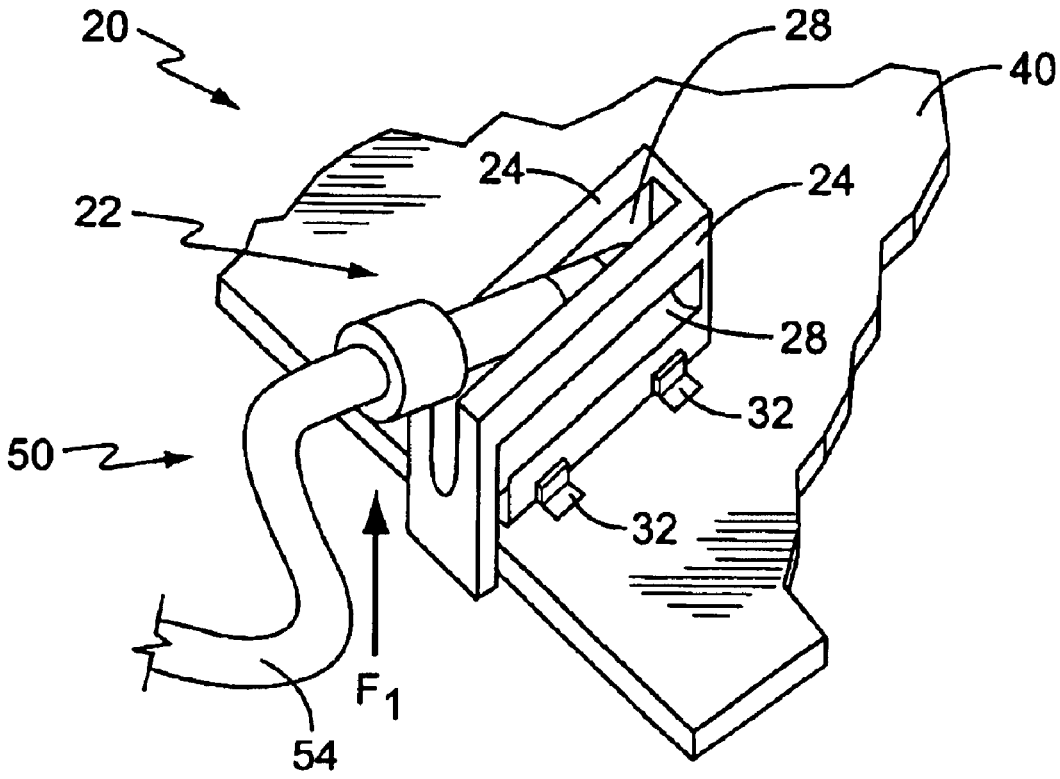

FIGS. 6*a*–6*c* illustrate examples of the angular displacements of the inserted plug 50 permitted by the illustrated embodiment. FIG. 6*a* shows the substantially horizontal displacing force, $F_2$, applied to the inserted plug 50, which causes the inserted portion of the inserted plug 50 to press against the opening 28. As the size $d_1$ of opening 28 is smaller than the diameter $d_2$ of the inserted plug 50, the opening 28 provides at least partial resistance to the movement of the inserted plug 50. However, if the displacing force $F_2$ reaches some threshold that threatens to break or crack the connector 20, or its corresponding connections to PCB 40, the opening 28 expands, allowing the inserted plug 50 to project through the opening 28 to assume a displaced position. Thus, connector 20 dissipates the impact forces by yieldably resisting the displacing movement of inserted plug 50, and permitting its partial angular displacement.

The use of flexible or pliable material for the housing 22, permits the openings 28 to expand or spread as the inserted plug 50 displaces from the inserted position to the displaced position. Although not required, the opening 28 may substantially conform to the shape of the inserted plug 50 as it projects through the opening 28. Further, upon removing the inserted plug 50 from the displaced position and re-inserting it into cavity 30, the opening 28 may return to its normal size and shape, due to the resiliency of the material.

In FIG. 6*a*, the displacing force $F_2$ resulted in an angular displacement that is generally horizontal with respect to the PCB 40. However, openings 28 may be disposed on any sidewall 24 in any orientation, thereby permitting angular displacements other than horizontal. For example, generally vertical displacements with respect to the PCB 40 are shown in FIGS. 6*b* and 6*c*. The displacing force $F_1$ can be seen as a substantially vertical impacting force exerted on the inserted plug 50, resulting in the generally vertical displacement of the inserted plug 50 through the top opening 28. It is understood, however, that the present invention is not limited to the vertical and horizontal displacements illustrated herein, but rather, encompasses any displacement of the inserted plug 50 through the openings 28. Thus, any number of openings 28 may be disposed in the sidewalls 24 to facilitate various angles of displacement with respect to the PCB 40.

Figure 7:
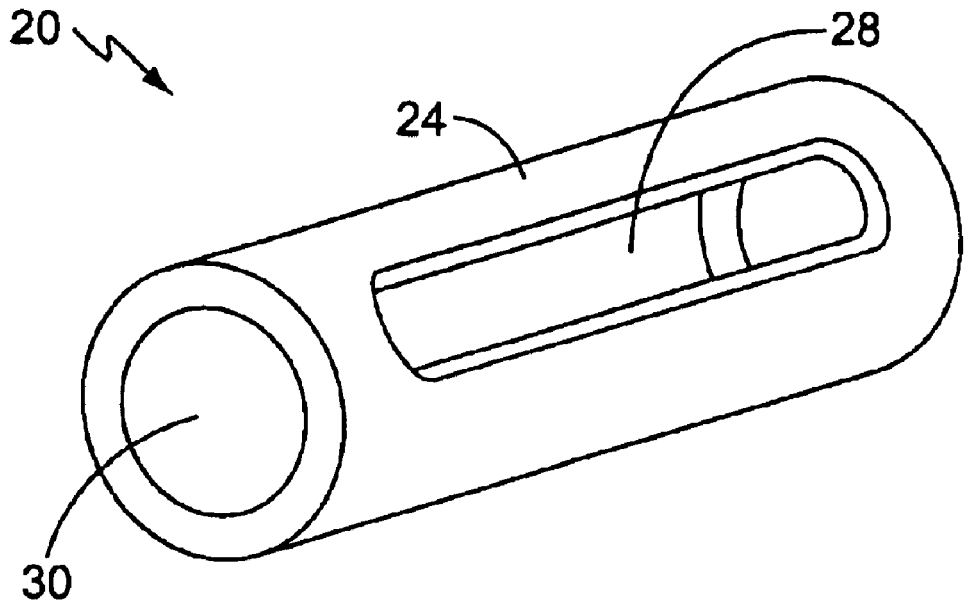
FIG. 7 illustrates an alternate embodiment of the present invention.

FIG. 7 illustrates an alternate embodiment of connector 20 having a substantially cylindrical housing 22. Plug 50 inserts into the cavity 30, while the one or more openings 28 permit the partial displacement of the inserted plug 50 through the openings 28. Those skilled in the art will readily appreciate that the one or more openings 28 need not be formed as cutouts in the sidewalls 24.

Figure 8:
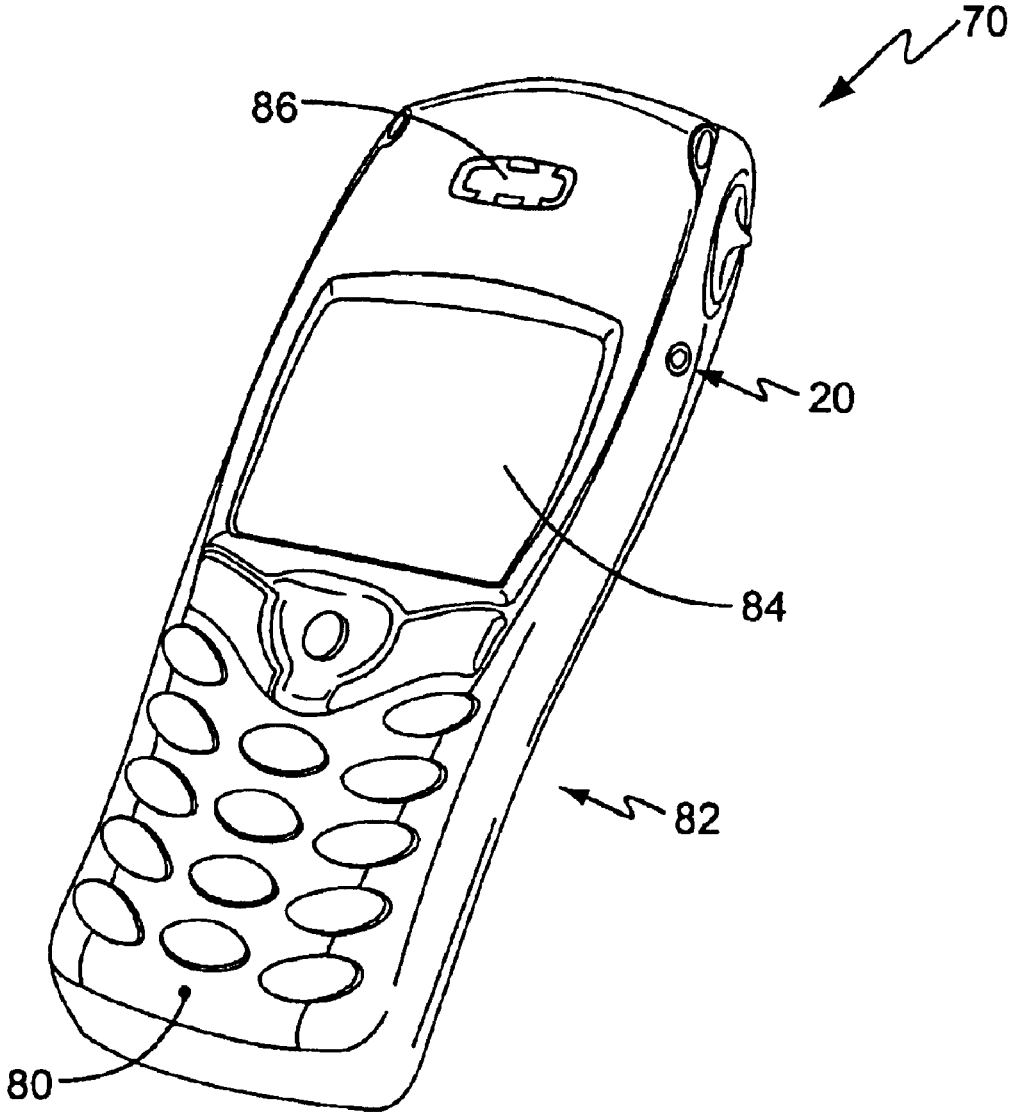
FIG. 8 illustrates one embodiment of the present invention used in a wireless communications device.

Referring now to FIG. 8, an exemplary embodiment of connector 20 is shown as it may be used in a wireless communications device, which is in this case, a mobile telephone 70. Mobile telephone 70 includes a display 84, a keypad 82, a speaker 86, a microphone 80, and the connector 20 of the present invention. Further, the PCB 40 is encased within mobile telephone 70, and includes one or more electrical circuits disposed thereon.

Figure 9:
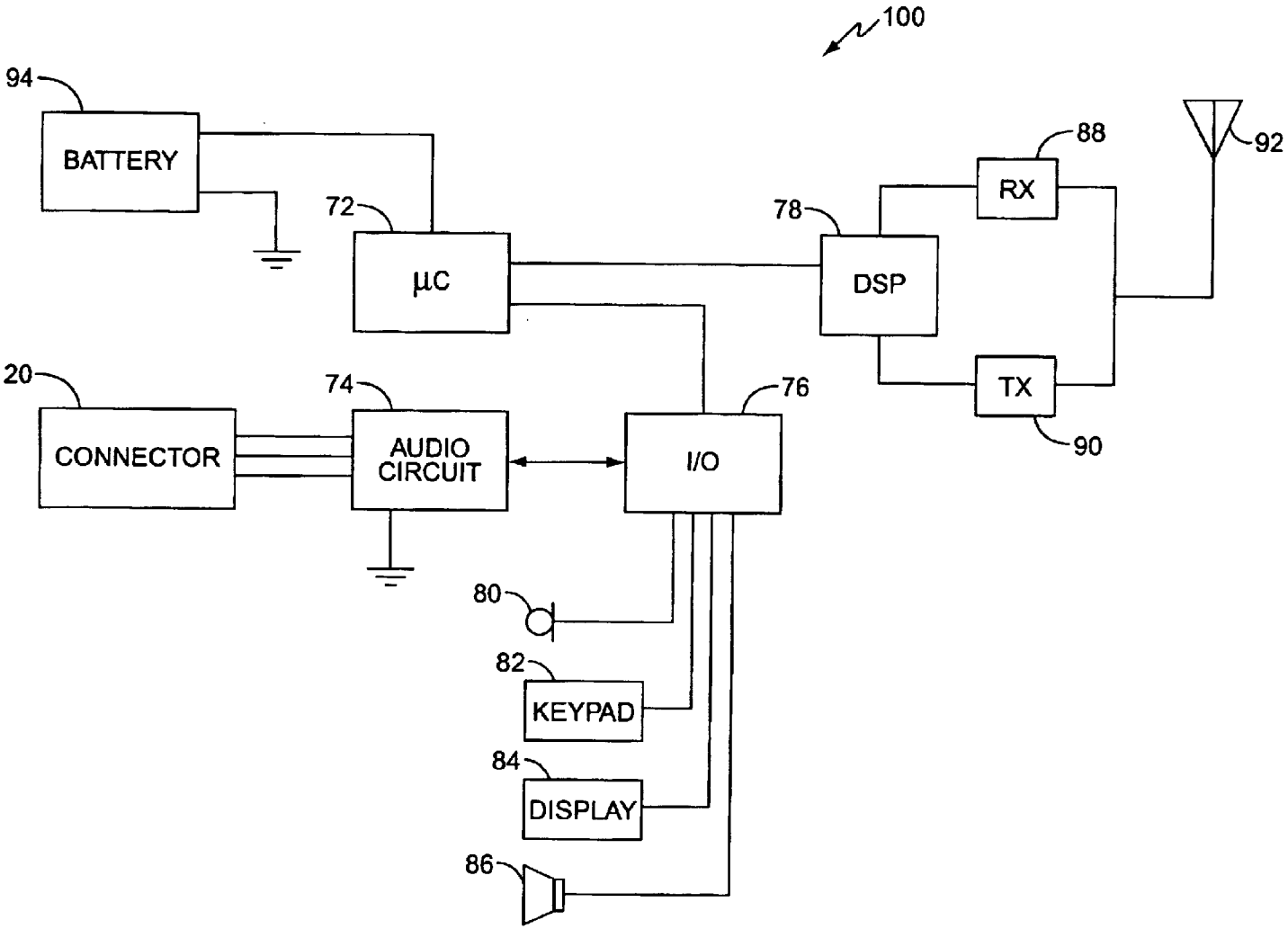
FIG. 9 is a schematic diagram of one embodiment of the present invention used as an audio jack.

FIG. 9 illustrates one embodiment of an electrical circuit, generally indicated by the number 100, wherein the connector 20 is configured for use as an audio jack. Electrical circuit 100 comprises a microprocessor 72 driven by a power source 94. Microprocessor 72 controls a digital signal processing circuit (DSP) 78, which is connected to a transmitter circuit 90 and a receiver circuit 88. Incoming and outgoing signals are transmitted and received via an antenna 92. An Input/Output (IO) circuit 76 connects the microphone 80, keypad 82, display 84, and speaker 86 to the microprocessor 72, as well as to an audio circuit 74, which is electrically coupled to connector 20 via contacts 26.

As stated above, plug 50 may be a segmented plug comprising a ground segment 56, an audio segment 58, and a microphone segment 60. Thus, at least three contacts 26 are disposed within cavity 30 to electrically couple each of the three segments 56, 58, and 60, to their corresponding contact points 42 on PCB 40. That is, the ground segment 56 couples to the ground circuit on the PCB 40, while the microphone and audio segments 58, 60, couple to the microphone and speaker circuits 80, 86 respectively. Thus, when the plug 50 assumes the inserted position, the user may communicate with a remote party through the hands-free headset. However, if an impact occurs to the inserted plug 50, openings 28 in the connector 20 permit the inserted plug 50 to displace from the inserted position to the displaced position. In this case, a user merely removes the displaced plug 50 from the connector 20, and re-inserts it.

Figure 10:
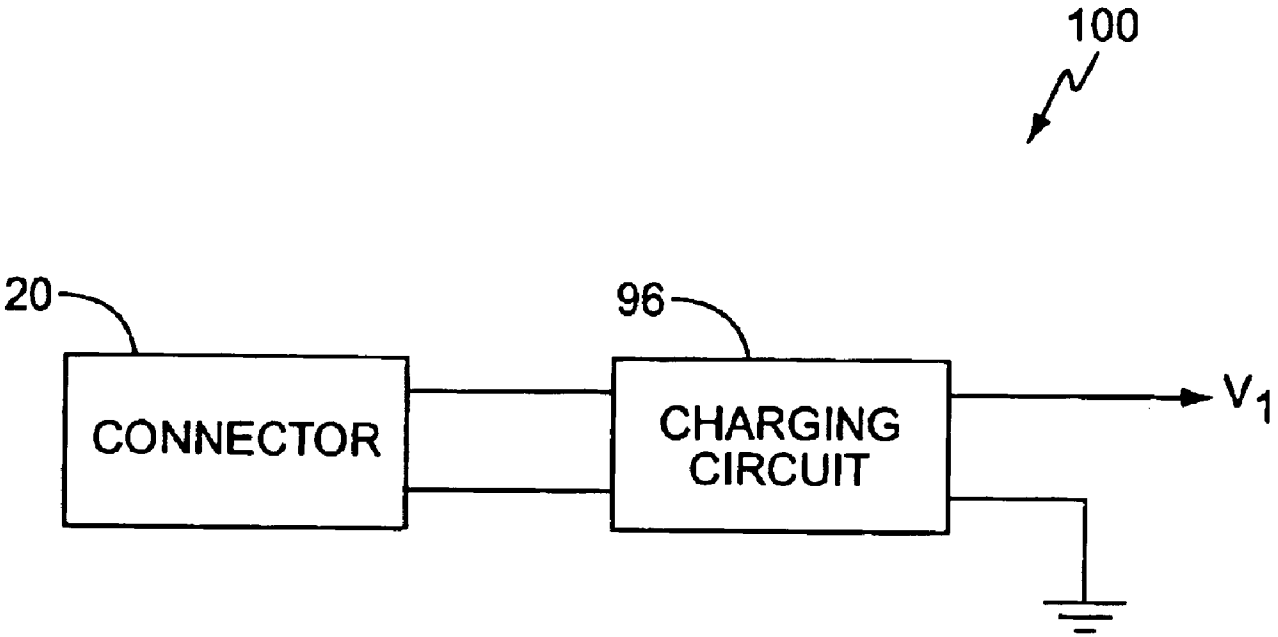
FIG. 10 is a schematic diagram of an alternate embodiment of the present invention used as a power jack.

FIG. 10 illustrates an alternate embodiment wherein the connector 20 is configured for use as a power jack. In this embodiment, connector 20 is coupled to a battery charging circuit 96 on the PCB 40, and may include only two contacts, ground and power (not shown). Using a peripheral device, such as an external battery charger (not shown), a user may recharge the battery, or provide power to mobile telephone 70.

The present invention may, of course, be carried out in other ways than those specifically mentioned herein without departing from the essential scope and characteristics of the invention. Therefore, the present embodiments are to be considered in all respects as illustrative and not restrictive, and all changes coming within the meaning and equivalency range of the appended Claims are intended to be embraced therein.

What is claimed is:

1. A connector for mounting on a printed circuit board comprising:

a housing having an insertion opening to allow insertion of a plug;

a receiving cavity within said housing to receive the inserted plug; and a said opening in a sidewall of the housing sized to yieldably retain the inserted plug, the side opening expanding responsive to an impact force on the inserted plug sufficiently to permit displacement of the inserted plug through the side opening.

2. The connector of claim 1 wherein the side opening is undersized with respect to a diameter of the inserted plug.

3. The connector of claim 1 wherein the housing is constructed from a pliable material that yieldingly responds to the impact force exerted on the inserted plug, resulting in the expansion of the side opening to permit the displacement of the inserted plug through the side opening.

4. The connector of claim 1 wherein the side opening is formed as a cutout in the housing.

5. The connector of claim 1 wherein the side opening is configured to permit an angular displacement of the inserted plug with respect to the printed circuit board.

6. The connector of claim 1 wherein the side opening is configured to permit a horizontal displacement of the inserted plug with respect to the printed circuit board.

7. The connector of claim 1 wherein the side opening is configured to permit a vertical displacement of the inserted plug with respect to the printed circuit board.

8. The connector of claim 1 further comprising one or more contacts disposed within the cavity that electrically couple the inserted plug to an electrical circuit on the printed circuit board.

9. The connector of claim 8 wherein the one or more contacts extend through the housing for mounting the connector to the printed circuit board.

10. The electronic device of claim 8 wherein the one or more contacts urge the inserted plug into surface contact with an inner surface of the housing to releasably retain the inserted plug.

11. The connector of claim 1 wherein the housing comprises one or more sidewalls, and wherein the side opening is a first side opening formed as a cutout in the one or more sidewalls.

12. The connector of claim 11 further comprising a plurality of side openings wherein each side opening in the plurality of side openings is substantially similar to the first side opening.

13. The connector of claim 12 wherein at least one side opening in the plurality of side openings is formed along a vertical plane with respect to the printed circuit board to permit a vertical displacement of the inserted plug through the at least one side opening.

14. The connector of claim 12 wherein at least one side opening in the plurality of side openings is formed along a horizontal plane with respect to the printed circuit board to permit a horizontal displacement of the inserted plug through the at least one side opening.

15. An electronic device comprising:

a printed circuit board having an electrical circuit; and a connector mounted to the printed circuit board, the connector comprising:

a housing having an insertion opening to allow insertion of a plug;

a receiving cavity within said housing to receive the inserted plug; and a side opening in a sidewall of the housing sized to yieldably retain the inserted plug, the side opening expanding responsive to an impact force on the inserted plug sufficiently to permit displacement of the inserted plug through the side opening.

16. The electronic device of claim 15 wherein the side opening is undersized with respect to a diameter of the inserted plug.

17. The electronic device of claim 15 wherein the housing is constructed from a pliable material that yieldingly responds to the impact force exerted on the inserted plug, resulting in the expansion of the side opening to permit the displacement of the inserted plug through the side opening.

18. The electronic device of claim 15 wherein the side opening is formed as a cutout in the housing.

19. The electronic device of claim 15 wherein the side opening is configured to permit an angular displacement of the inserted plug with respect to the printed circuit board.

20. The electronic device of claim 15 wherein the side opening is configured to permit a horizontal displacement of the inserted plug with respect to the printed circuit board.

21. The electronic device of claim 15 wherein the side opening is configured to permit a vertical displacement of the inserted plug with respect to the printed circuit board.

22. The electronic device of claim 15 wherein the electronic device comprises a wireless communications device.

23. The electronic device of claim 22 where in the wireless communications device is a mobile telephone.

24. The electronic device of claim 15 further comprising one or more contacts disposed within the cavity that electrically couple the inserted plug to the electrical circuit.

25. The electronic device of claim 24 wherein the one or more contacts urge the inserted plug into surface contact with an inner surface of the housing to releasably retain the inserted plug.

26. The electronic device of claim 24 wherein the inserted plug is a segmented plug including a plurality of contact points, and wherein the one or more contacts electrically couple the plurality of contact points to the electrical circuit.

27. A method of providing stress relief to a board mounted connector, having a plug inserted in the connector, responsive to an impact force exerted on the inserted plug, the method comprising:

inserting a plug through an insertion opening in a housing of the connector;

releasably retaining the inserted plug in a receiving cavity within the housing of the connector; and providing one or more flexible side openings in a sidewall of the connector housing sized to yieldably retain the inserted plug in an inserted position, the side openings expanding responsive to the impact force sufficiently to permit displacement of the inserted plug through the one or more side openings.

28. The method of claim 27 wherein releasably retaining the inserted plug in the receiving cavity comprises disposing one or more contacts in the receiving cavity to urge the inserted plug into surface contact with an inner surface of the connector housing.

29. The method of claim 27 wherein the flexible side openings comprise cutouts in the connector housing that yieldably resist displacement of the inserted plug from the inserted position to a displaced position with respect to the printed circuit board.

30. A connector for mounting on a printed circuit board comprising:

a housing;

an entry opening in the housing to receive a plug inserted into the housing; and a side opening in a sidewall of the housing that intersects the entry opening, wherein the side opening is sized to yieldably retain the inserted plug within the housing, and to expand responsive to an impact force on the inserted plug sufficiently to permit displacement of the inserted plug through the side opening.

* * * * *